US011161674B2

(12) United States Patent
Bürkle

(10) Patent No.: US 11,161,674 B2
(45) Date of Patent: Nov. 2, 2021

(54) TWO-COMPONENT PRESSURIZED CAN

(71) Applicant: SIKA TECHNOLOGY AG, Baar (CH)

(72) Inventor: Jochen Bürkle, Steinheim an der Murr (DE)

(73) Assignee: SIKA TECHNOLOGY AG, Baar (CH)

( * ) Notice: Subject to any disclaimer, the term of this patent is extended or adjusted under 35 U.S.C. 154(b) by 0 days.

(21) Appl. No.: 16/767,281

(22) PCT Filed: Nov. 27, 2018

(86) PCT No.: PCT/EP2018/082638

§ 371 (c)(1),
(2) Date: May 27, 2020

(87) PCT Pub. No.: WO2019/102025

PCT Pub. Date: May 31, 2019

(65) Prior Publication Data

US 2021/0114792 A1 Apr. 22, 2021

(30) Foreign Application Priority Data

Nov. 27, 2017 (DE) ..... 102017127911.3

(51) Int. Cl.
*B65D 81/32* (2006.01)
*B65D 83/66* (2006.01)
*B65D 83/68* (2006.01)

(52) U.S. Cl.
CPC ..... *B65D 81/3222* (2013.01); *B65D 83/666* (2013.01); *B65D 83/687* (2013.01)

(58) Field of Classification Search
CPC ..... B65D 81/3222; B65D 83/666; B65D 83/687; B65D 81/325
(Continued)

(56) References Cited

U.S. PATENT DOCUMENTS 3,437,242 A * 4/1969 Poitras ..... B65D 81/3255 222/135
3,727,797 A 4/1973 Cronan
(Continued)

FOREIGN PATENT DOCUMENTS

EP 0482319 A1 4/1992
WO 8500157 A1 1/1985

OTHER PUBLICATIONS

Feb. 18, 2019 International Search Report issued in International Patent Application No. PCT/EP2018/082638.

*Primary Examiner* — Vishal Pancholi
(74) *Attorney, Agent, or Firm* — Oliff PLC

(57) ABSTRACT

A two-component pressurized can having a body, a dome, a valve arranged in the dome, an inwardly curved bottom, an upper chamber and a lower chamber for a first and a second component, which chamber are separated from one another by a separating element, and an opening device which is arranged in the bottom, can be activated from outside and, upon actuation, removes the separation between the chambers for the first and second component, wherein the separating element between the chambers is a piston which is mounted so as to be displaceable in the pressurized can and which has at least one opening closed by a closure element, and the opening device has an opening element which extends through a passage in the bottom and is suitable for separating the closure element from the at least one opening of the piston.

13 Claims, 2 Drawing Sheets

Figure 1:
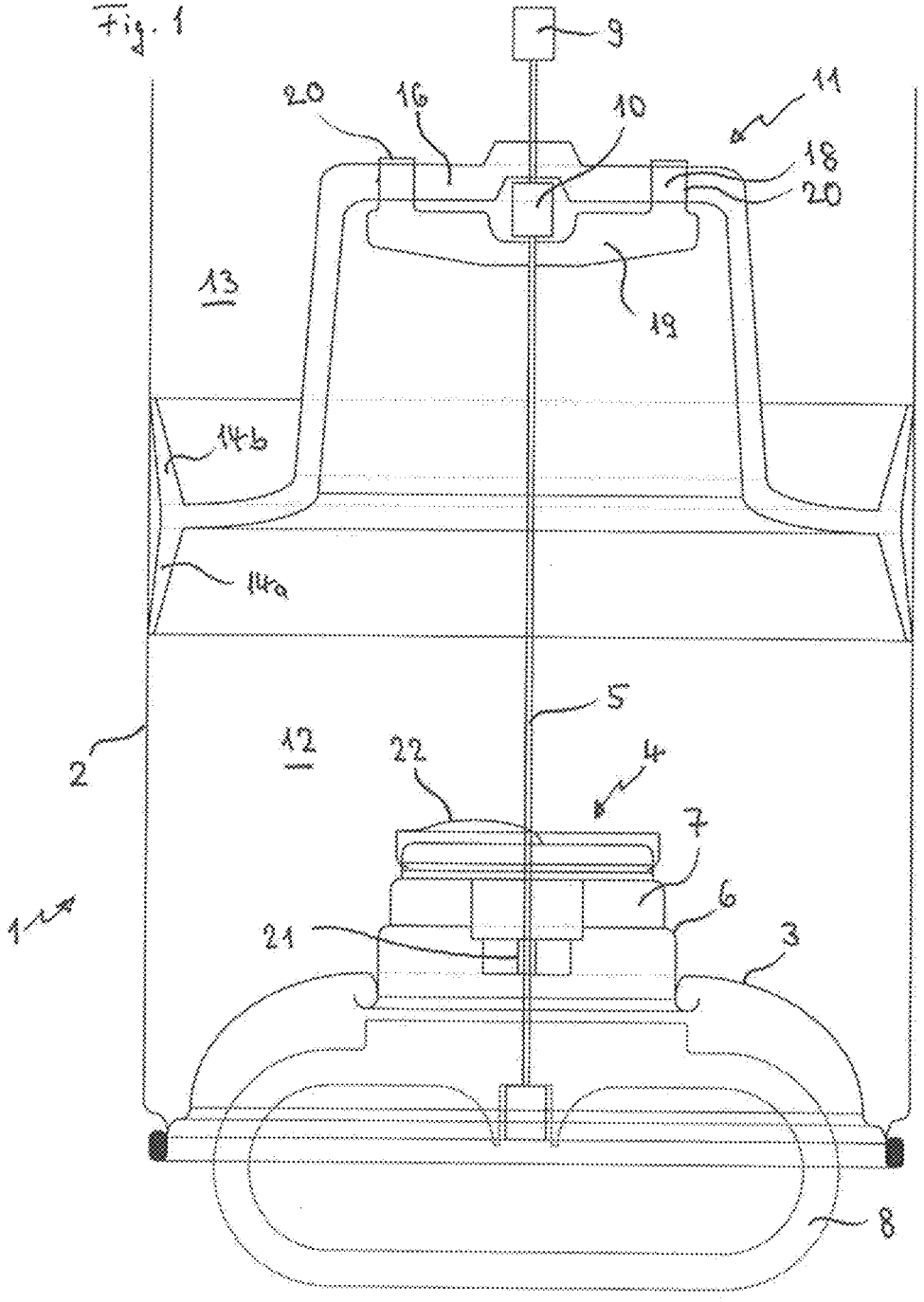

(58) Field of Classification Search
USPC ..... 222/145.5
See application file for complete search history.

(56) References Cited

U.S. PATENT DOCUMENTS 4,651,899 A * 3/1987 Pauls ..... B65D 81/32 222/130
4,749,105 A * 6/1988 Derksen ..... B65D 83/0022 222/80
5,082,146 A * 1/1992 Hardt ..... B65D 83/687 222/135
5,215,225 A * 6/1993 Kopp ..... B65D 81/3222 206/219
5,573,137 A * 11/1996 Pauls ..... B65D 83/64 222/129
7,455,195 B2 * 11/2008 Mekata ..... B65D 83/40 222/94
8,025,168 B2 * 9/2011 Bullard ..... A61J 9/00 215/11.1
8,672,186 B2 * 3/2014 Geiberger ..... B05B 11/00416 222/135
2007/0251954 A1 * 11/2007 Fazekas ..... B65D 83/687 222/135

* cited by examiner

TWO-COMPONENT PRESSURIZED CAN

The invention relates to a two-component pressurized can, having a body, a dome, a valve arranged in the dome, an inwardly curved bottom, an upper chamber and a lower chamber for a first and a second component, which chambers are separated from one another by a separating element, and an opening device which is arranged in the bottom, can be actuated from outside, extends through a passage in the bottom and, upon actuation, removes the separation between the chambers for the first and second component.

The pressurized can is suited and intended in particular for storing and dispensing two-component systems, for example assembly foams having a curing agent component and/or filler component.

The invention relates to the formation of pressurized cans which, in addition to the substances of the main component, receive a second component which reacts with the main component to form the finished product, a multicomponent system. Such systems are used in particular in assembly and insulation technology, for example for foaming in door and window frames, for foaming shut wall breaches and gaps, for sound and heat insulation, and also for the production of foams which acquire fire-retardant properties by virtue of mineral additives. Equally, such two-component systems can be used for the production of two-component coatings and two-component adhesives.

The substances of the main component that are contained in the pressurized container are liquid and, in the case of an assembly foam, comprise for example a polyurethane prepolymer having terminal reactive isocyanate groups. Further customary substances are generally present. The main component further contains a liquid gas component which serves to drive out and foam the can contents. The liquid gas component simultaneously serves as a solvent.

In the case of an assembly foam, the second component contains, in addition to other components, a crosslinker which is capable of reacting with the reactive isocyanate groups of the main component. This is generally a substance having reactive hydrogen atoms, for example water or a polyol. The reaction with the main component proceeds directly after combining the components, with the result that the dispensing of the mixture has to begin directly after the two components have been mixed. The reaction and the foaming by means of the propellant gas lead to the formation of the more or less rigid assembly foam at the site of use.

As a rule, the second component of a two-component pressurized can is held available in a separate sleeve which is arranged on the bottom of the pressurized can and can be activated through the bottom by a triggering mechanism. This occurs for example by means of a plunger which projects into the inner sleeve from outside and is displaced by pressing in against the cover of the inner sleeve and ejects this cover. Subsequent thereto, the contents of the inner sleeve can be mixed with the can contents by shaking and the then already reacting product mixture can be dispensed. Reference is made by way of example to WO 85/00157 A.

These inner sleeves have fundamentally proven to be very acceptable, but have the disadvantage that, for a voluminous second component, the inner sleeve offers too little space. This applies particularly when a relatively large amount of a second component, for example a fire retardant contained in a carrier liquid, is intended to be admixed with the main component. Such fire retardants, usually of mineral nature, for instance graphite or hydrated aluminum oxide, have proven incompatible with the prepolymer, with the result that they can be admixed with the main component only directly before emptying the pressurized can. As a rule, the second component additionally also contains a crosslinker and further customary additives.

There is therefore sought a two-component pressurized can which allows for even relatively large amounts of a second component to be accommodated such that the two components are strictly separated from one another during the storage time, but can be brought into connection with one another and thoroughly mixed before emptying the pressurized can.

This is achieved by a two-component pressurized can of the type described at the outset, in which the separating element between the chambers is a piston which is mounted so as to be displaceable in the pressurized can and which has at least one opening closed by a closure element, and the opening device has an opening element which is suitable for separating the closure element from the at least one opening of the piston.

The two-component pressurized can according to the invention is primarily intended for dispensing assembly foams having a curing agent component and/or filler component, with it being possible for the filler component to be a fire retardant, for instance graphite, but also a mineral additive for influencing the foam properties. In principle, however, such two-component pressurized cans are also suitable for two-component coatings, two-component adhesives and other two-component systems which are stored in a pressurized can and dispensed from a pressurized can under reaction. Here, the distribution of the two components between the two chambers is arbitrary and can be carried out according to the respective requirements.

The invention allows for the volumes of the upper and the lower chamber to be tailored to the requirements of the respective application. Thus, virtually any desired mixing ratios of the first component to the second component of 10:90 to 90:10, according to volume, are readily possible. The requisite adaptation of the pressurized can requires no major technical effort or outlay; only the length of the opening element has to be varied for this purpose.

The pressurized can according to the invention has, in a conventional manner, a dome with an inserted valve, a body and an inwardly curved bottom which is fitted into the body. An opening for the opening device which can be actuated from outside via a triggering member is arranged centrally in the bottom. However, by contrast with conventional two-component pressurized cans, the body has arranged therein a piston which is movable in the vertical direction and which subdivides the pressurized can space into a lower chamber and an upper chamber.

The piston, which is fitted movably into the body in order to divide the can interior, is sealingly adapted in its edge region to the body wall. For this purpose, it expediently has, on the wall side, at least one flexible sealing lip. A preferred embodiment provides two dovetail-like sealing lips which are guided in spread-out form on the body wall.

Here, the sealing lips delimiting the upper and lower chamber can be of symmetrical or asymmetrical design; the length of the sealing lip delimiting the lower chamber is dimensioned in particular such that it butts against the can bottom when the aerosol can is completely emptied.

Since the same pressure prevails in the lower and upper chamber in the operationally pressurized can, no pressure-induced sealing tightness problems result; a customary elastic plastic from which at least the sealing lips, and possibly also the piston, are manufactured is generally sufficient for producing the sealing tightness. Pressure differences are compensated for by movement of the piston and/or by a gas transfer between the chambers, even through the plastic of the piston.

It goes without saying that the piston can also consist of metal, for example tinplate or aluminum. Sealing with respect to the inner can wall can be effected here for example by way of a sealing ring or the above-described sealing lip system. The sealing means is adhesively bonded to the outer piston wall, for example.

In the case of pressurized cans which have a weld seam, it may be expedient to provide on the inside a coating layer which compensates for unevennesses due to the welding and thus gives rise to a better sealing closure with the piston.

Of course, the piston of the pressurized can can be guided by its wall on the inner body wall, wherein one or more O-rings, for example, are provided to produce the sealing tightness. These O-rings are expediently arranged in depressions which run annularly around the outer wall of the piston.

The piston serves as a separating element between the chambers for the first and the second component. In order to be able to mix the two components with one another, it has at least one opening closed by a closure element, expediently arranged centrally in the piston middle or, in the case of a plurality of openings, arranged around the piston middle. Before use of the can, the closure element for the opening can be opened by way of the opening device which can be actuated from outside, wherein the opening device separates the closure element from the piston and thus frees the passage between the two chambers.

The mixing of the two components in the chambers can be brought about in principle by shaking the can, which is as a rule filled approximately only to the extent of 75%. Here, balls or rods, for example made of metal or ceramic, introduced into the pressurized can are able to promote the mixing operation.

An opening device is expedient which is suitable not only for separating the closure element from the piston but at the same time can also move the piston toward the can bottom and thus brings about a forced mixing of the chamber contents. The opening device is arranged on the bottom of the pressurized can and can be actuated through the bottom from outside.

The closure element is expediently a membrane, a cover or a plug, preferably a plug which is fitted into the at least one opening from the underside of the piston.

If only one opening is present, it is expediently arranged centrally on the piston roof and extends over one sixth to one third of the can diameter in order to allow rapid mixing of the chamber contents. A plurality of openings can be arranged concentrically around the piston middle and have the advantage of good forced mixing of the two components when the piston is moved toward the can bottom. The closure element is expediently a plug which can be fitted into and pulled out of the at least one opening from below, that is to say from the lower chamber.

The opening element of the opening device can be, for example, a pull rod, a pull band, a pull cable or a pull wire. Preference is given to a pull wire which is led through the can bottom and can be actuated from outside.

The pull wire and pull rod serve both to separate the closure element from the piston and to move the piston downward, in the direction of the can bottom. For this purpose, the opening mechanism needs two steps. In a first step, the closure element is released from the piston and hence the passage between the chambers is freed. In the second step, the piston is pulled downward, in the direction of the can bottom, with the aid of the opening element, which has the effect that the content of the lower chamber flows into the upper chamber and mixes there with the content of the upper chamber.

In each case, the opening element projects outwardly through the bottom of the pressurized can and can be operated from outside.

The opening element is preferably a pull wire which is equipped in the terminal region with two drivers. The pull wire reaches through the bottom into the lower chamber and through the closure element into the upper chamber. The first driver is situated in the upper chamber in the end region of the pull wire, and the second driver is situated, spaced apart therefrom, below the piston roof, but above the plug arranged below the piston. Upon actuation of the pull wire, first of all the plug is pulled out of the openings by way of the lower driver, with the result that the connection to the upper chamber becomes free, and then the piston is pulled downward, in the direction of the bottom, thereby combining the contents of the two chambers.

A pull rod can be formed in a corresponding manner.

The opening device is situated in the bottom region of the pressurized can and comprises, in addition to the opening element, in particular also a sleeve for the opening element, said sleeve being anchored in a bottom plate in the inwardly curved bottom of the pressurized can and having the necessary sealing elements for leading the opening element through the bottom. Outside the pressurized can, the opening element expediently has a handle which, when pulled, activates the pressurized can. The handle can be readily arranged in the inwardly curved bottom of the pressurized can.

The piston arranged in the pressurized can preferably has a cup shape which is adapted to the dimension of the opening device arranged on the can bottom. In this way, the content of the pressurized can situated in the lower chamber can be virtually completely mixed with the content of the upper chamber. At the same time, damage to the opening mechanism arranged on the can bottom is ruled out in the critical activation phase.

Figure 2:
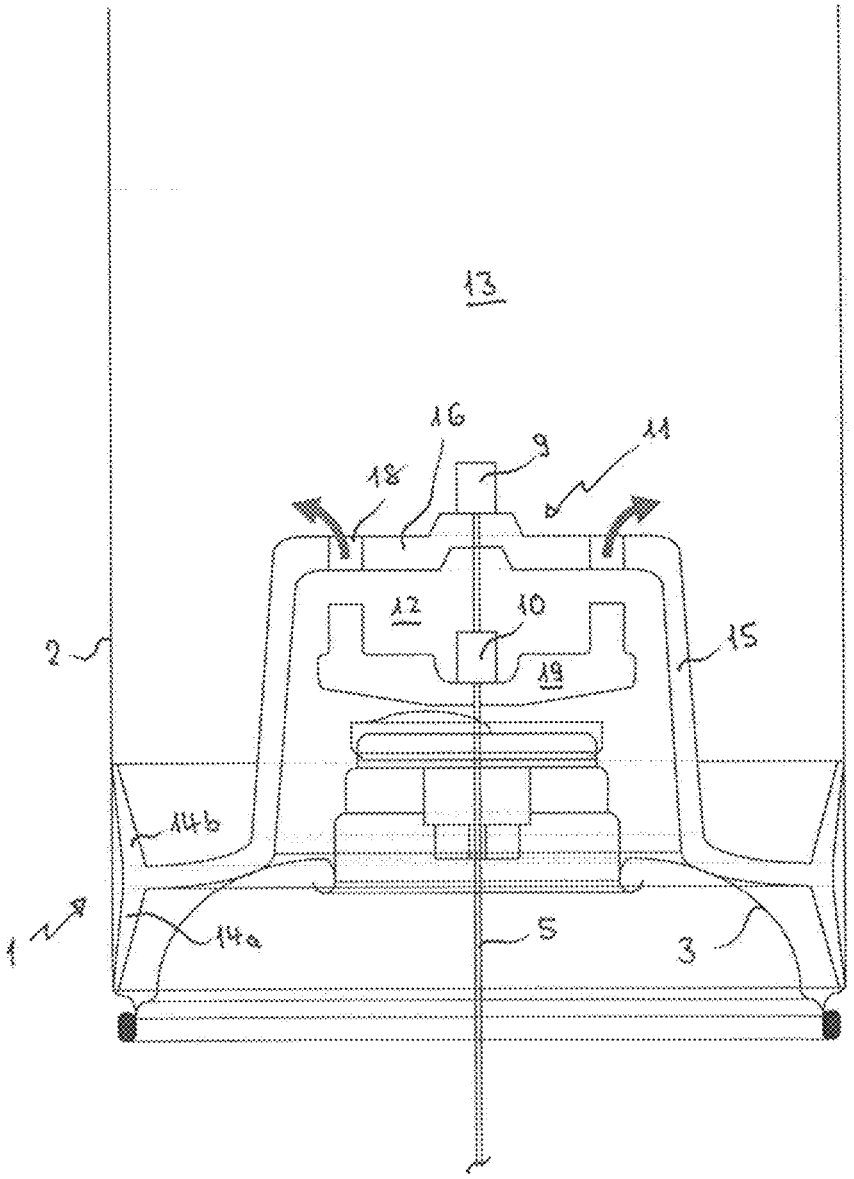

The invention will be explained in more detail by means of the appended drawings, in which:

FIG. 1 shows the lower part of a pressurized can according to the invention before activation; and FIG. 2 shows the pressurized can from FIG. 1 after activation.

FIG. 1 is a longitudinal section showing the lower part of a pressurized can according to the invention with the piston and the opening device. The upper part (not shown) has a customary design and largely corresponds to the upper part of the pressurized can described in WO 85/00175 A. The pressurized can according to the invention differs from this prior art in that the second component is not accommodated in an inner sleeve on the can bottom, but in a second chamber below the movably arranged piston.

The two-component pressurized can 1 according to the invention consists of a body 2, a dome (not shown), a valve (likewise not shown) arranged in the dome, an inwardly curved bottom 3 and an opening device 4 which can be actuated through the bottom from outside. The opening device 4 consists of a pull wire 5, a passage element 7 crimped into a bottom plate 6, a handle 8, which is arranged below the bottom 3 and is situated outside the pressurized can 1, and two drivers 9 and 10 which are situated in the upper region (valve-side region) of the pull wire 5. These drivers 9 and 10 are fixedly connected to the pull wire 5.

Within the pressurized can 1 there is situated the piston 11 which subdivides the inner space of the pressurized can 1 into a lower chamber 12 and an upper chamber 13.

The outer edge of the piston 11 is formed by 2 sealing elements 14*a* and 14*b* which bear tightly against the inner side of the can body 2. The sealing lips 14*a* and 14*b* are spread in dovetail fashion and are supported sealingly on the inner wall of the can body 2.

The piston 11 itself consists, in its central part, of a cup-shaped structure 15 with a roof 16 and a laterally extending edge or collar 17 which terminates in the sealing lips 14*a* and 14*b*. Within the roof 16 there are arranged openings or apertures 18, of which two are illustrated. Further ones can extend concentrically around the piston middle.

In the nontriggered (nonactivated) state of the pressurized can, the openings 18 are closed by a plug 19 which projects into the piston 11 from below and which has a plurality of prongs 20. A prong 20 is provided for each opening 18. These prongs 20 are sealingly fitted to the openings 18, with the result that a passage of the first component contained in the upper chamber 13 into the lower chamber 12 or of the second component contained in the lower chamber 12 into the upper chamber 13 is ruled out.

The pull wire 5 is led, on the one hand, through the cover 19 and, on the other hand, through the roof 16 of the piston 11. Here, in each case, the leadthrough through the roof 16 is of sealing design, with the result that, here too, an exchange of the components contained in the two chambers can not take place. Where the components contained in the chambers are reactive with one another, sealing is brought about in any case by contact of the components in the region of the leadthrough through the roof 16.

The pull wire 5 has the drivers 9 and 10 spaced apart from one another with the upper driver 9 being situated in the upper chamber 13 and the lower driver 10 situated in the lower chamber 12, but above the plug 19 in a recess. The spacing between the drivers 9 and 10 is such that, upon triggering the pressurized can by way of the pull wire, first of all the cover 19 is pulled away from the openings 18, with the result that the path between the two chambers 12 and 13 becomes free. Only in a second step, with the pull wire 5 pulled out further, does the piston 11 move in the direction of the can bottom 3. As a result, the volume of the lower chamber 12 is reduced in favor of the upper chamber 13, which forces the content of the lower chamber 12 into the upper chamber 13. The multiplicity of the openings 18 brings about good distribution and mixing in the upper chamber 13 of the second component contained in the lower chamber 12.

The cup-shaped configuration of the piston 11 takes account of the configuration of the passage 7 which is arranged in the can bottom 3, of the opening device 4. This ensures substantial residual emptying of the lower component into the upper chamber 13.

The passage 7 of the opening device 4 is crimped into a bottom plate 6, which in turn is crimped with the bottom 3 of the pressurized can 1. It goes without saying that the passage contains at least one sealing element 21 which prevents liquid escaping from the lower chamber 12 to the outside. This sealing element can be present for example in the form of a rubber plug 21 which has a central bore and tightly encloses the pull wire 5.

On the valve side, the passage 7 has a spring element 22 which, after triggering the pressurized can, is intended to resiliently cushion the pulled-down cover/piston.

The body 2 of the can 1 can be manufactured from aluminum and, in this case, has no seam. In that case, no sealing problem arises between the piston and body. In the case of welded cans, however, unevennesses can occur in the region of the weld seam, and therefore, in this case, an inner coating of the can that is known in and of itself may be expedient.

In the nonactivated state, the pressurized can according to the invention can be stored over a long time, because the two components in the chambers 12 and 13 are hermetically enclosed therein. It is only by triggering that the pressurized can is activated. For this purpose, the pull wire 5 is pulled downward with the aid of the handle 8, which releases the plug 19 in a first step and, in a second step, moves the piston 11 by way of the driver 9 toward the bottom 3 of the can 1.

FIG. 2 shows the pressurized can 1 corresponding to FIG. 1 after triggering. The piston 11 has been pulled in the direction of the can bottom 3 with the aid of the guide wire 5 and the driver 9 and is situated in its lowermost bottom-side position. The driver 9 lies directly on the piston roof 16. The lower chamber 12 has been reduced apart from a residual volume in the region of the piston cup 15, and the content of the lower chamber 12 flows (arrows) into the upper chamber 13. The cover 19 has been separated from the piston roof 16 and has freed the openings 18. The sealing lips 14*a* and 14*b* are likewise situated in their lowermost bottom-side position; this time, however, they no longer have a function. However, the lower sealing lip 14*b* ensures, by way of its abutment on the lower end of the body 2 or on the can bottom 3, that the piston cup 15 does not touch the opening device.

The invention claimed is:

1. A two-component pressurized can having a body, a dome, a valve arranged in the dome, an inwardly curved bottom, an upper chamber and a lower chamber for a first and a second component, which chambers are separated from one another by a separating element, and an opening device which is arranged in the bottom, can be actuated from outside and, upon actuation, removes the separation between the chambers for the first and second component, wherein the separating element between the chambers is a piston which is mounted so as to be displaceable in the pressurized can and which has at least one opening closed by a closure element, and the opening device has an opening element which extends through a passage in the bottom and is suitable for separating the closure element from the at least one opening of the piston.

2. The pressurized can as claimed in claim 1, wherein the closure element is a membrane, a cover or a plug.

3. The pressurized can as claimed in claim 1, wherein the piston has a plurality of concentrically arranged openings.

4. The pressurized can as claimed in claim 1, wherein the closure element is a plug which is sealingly fitted into the at least one opening.

5. The pressurized can as claimed in claim 4, wherein the plug closes the at least one opening from the side facing toward the lower chamber.

6. The pressurized can as claimed in claim 1, wherein the opening element is a pull wire.

7. The pressurized can as claimed in claim 6, wherein the pull wire has two spaced-apart drivers, of which the lower one acts on the closure element and the upper one acts on the piston.

8. The pressurized can as claimed in claim 1, wherein the piston has, on the wall side, at least one flexible sealing lip.

9. The pressurized can as claimed in claim 8, wherein, as viewed in cross section, the piston has two dovetail-like sealing lips.

10. The pressurized can as claimed in claim 1, wherein the bottom has a crimped-in bottom plate with the passage for the opening element.

11. The pressurized can as claimed in claim 10, wherein the passage takes the form of a sleeve for the opening element and has at least one sealing element.

12. The pressurized can as claimed in claim 1, wherein the opening device has a pull wire with drivers for the closure element and for the piston, and a handle, wherein the handle is arranged outside the pressurized can and below the bottom.

13. The pressurized can as claimed in claim 1, wherein the piston has the form of an inverted cup whose interior is configured dimensionally such that it can receive within it the passage arranged on the bottom of the pressurized can.

* * * * *